United States Patent [19]

Orke et al.

[11] 4,146,768

[45] Mar. 27, 1979

[54] DOOR FOR A MICROWAVE OVEN

[75] Inventors: Gustav G. Orke; Bengt T. L. Lindström, both of Nörrköping, Sweden

[73] Assignee: U.S. Philips Corporation, New York, N.Y.

[21] Appl. No.: 825,304

[22] Filed: Aug. 17, 1977

[30] Foreign Application Priority Data

Aug. 18, 1976 [SE] Sweden ..... 7609170

[51] Int. Cl.[2] ..... H05B 9/06

[52] U.S. Cl. ..... 219/10.55 D; 29/592 R; 126/200; 174/35 MS

[58] Field of Search ..... 219/10.55 D, 10.55 F, 219/10.55 R; 174/35 R, 35 MS; 126/200; 29/592 R

[56] References Cited

U.S. PATENT DOCUMENTS

| | | | |
|---|---|---|---|
| 3,809,843 | 5/1974 | Takayama | 219/10.55 D |
| 3,835,283 | 9/1974 | Suzuki | 219/10.55 D |
| 3,879,595 | 4/1975 | Lamb | 219/10.55 D |
| 4,008,383 | 2/1977 | Tanaka et al. | 219/10.55 D |

*Primary Examiner*—Arthur T. Grimley

*Attorney, Agent, or Firm*—David R. Treacy; Bernard Franzblau

[57] ABSTRACT

A microwave oven having an access door comprising a metal door frame with a choke cavity and a perforated metal sheet covering the area inside the frame. The door frame consists of a U-shaped metal profile with the legs of the U oriented in the plane of the door so as to effect an energy seal between the frame and the perforated metal sheet by pressing the sheet against the outside planar area of one of the legs of the profile.

7 Claims, 3 Drawing Figures

DOOR FOR A MICROWAVE OVEN

Figure 1:
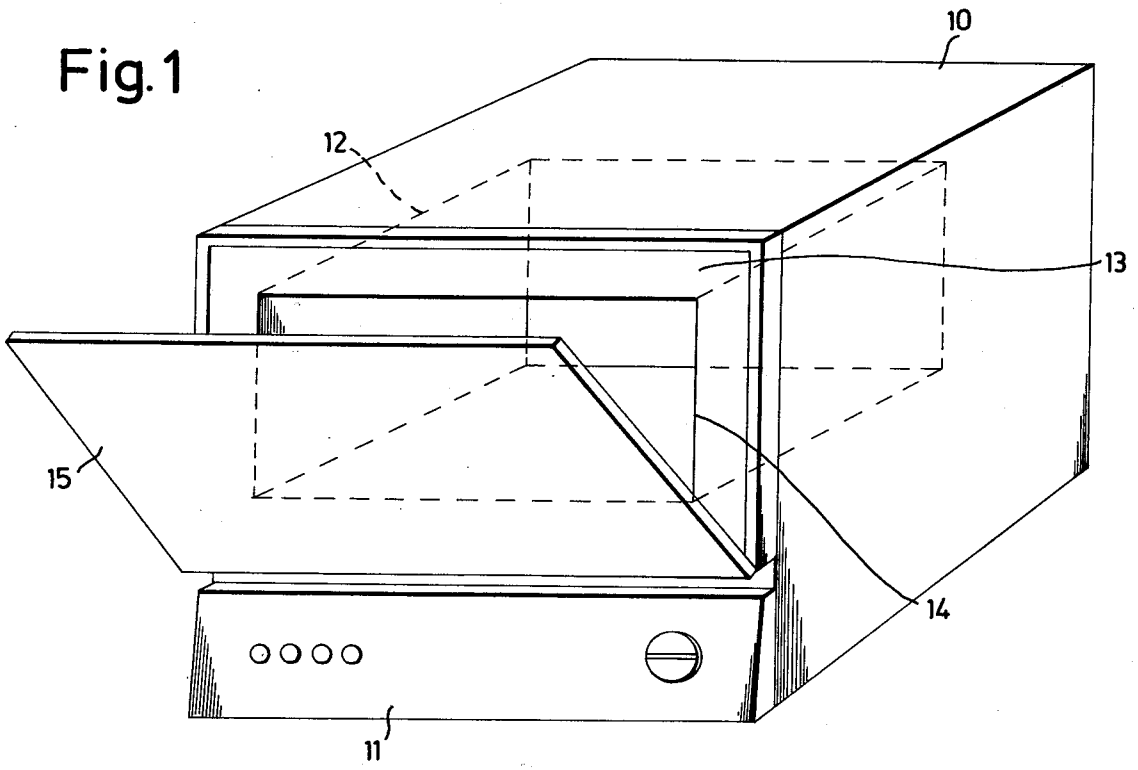

The invention relates to a door for a microwave oven adapted to close an entrance opening to an oven cavity limited by conductive walls and comprising an inner door frame in the shape of a metal profile extending around the circumference of the door and comprising a choke cavity and a perforated metal sheet overlapping the metal profile and covering the area inside the door frame.

For preventing microwave leakage in the door itself an effective energy seal must be present between the perforated metallic sheet and the metal profile in the door frame. In a previously proposed door construction of this kind this has been achieved by providing the metal profile on the said overlapping surface with closely arranged projecting tabs or pins and the metal sheet is provided with corresponding apertures. At the mounting together of the door in this known construction the said tabs or pins on the profile are introduced into the apertures in the metal sheet and electric contact is ensured in at least one point of each projecting tab, for example by deforming the tabs after the introduction or by providing the tabs or pins with a conic shape or projecting ribs that cut into the metal sheet during the assembly procedure.

This is a complicated and expensive method as both the metal profile and the perforated sheet must be shaped in a special manner and furthermore a special working operation is required for ensuring the effective electric contact.

An object of the invention is to achieve a door construction which is simpler as to its construction and furthermore very simple to mount together, but which in spite of this will produce an effective sealing action.

According to the invention this has been achieved in that the metal sheet bears against the outside of a portion of the metal profile forming a leg in an, as seen in a sectional view, U-shaped choke cavity the depth of which, determined by the length of the said leg, is of the magnitude of a quarter of a wavelength of the oven operation frequency. The said portion of the metal profile overlapped by the metal sheet is substantially planar and the metal sheet is kept pressed against the metal profile with the aid of a mechanical compression means acting between a part bearing against the outside of the metal sheet and the metal profile.

Aside from the fact that the door with this orientation of the choke will provide a thin and planar shape, a large contact surface between the outside of the metal profile and the metal sheet will be achieved, whereby a good sealing action is ensured without special measures, in particular without the requirement that a galvanic contact must be maintained between sheet and profile. The compression means may suitably act against the edge portion of a transparent disk placed on the outside of the metal sheet. whereby a good pressure distribution and a good contact between the metal sheet and metal profile will be obtained. According to a feature of the invention the said compression means may comprise a shoulder on an outer frame bearing against the outside of the transparent disk, which outer frame by means of screws or other mechanical connection means is pressed against the metal profile so that the shoulder presses the disk against the outside of the metal profile with intermediate perforated metal sheet. The outer door frame can be a mechanically rigid frame and for example be moulded in one piece, while the inner door frame suitably in composed of a number of sections of the metal profile.

The assembly of such a door will be very simple and can be effected such that the outer door frame is first placed with its outside downward on a support, whereafter the transparent disk is put into the outer frame, the perforated sheet is placed upon the disk and possibly an inner transparent disk is placed upon the sheet, whereafter sections of the metal profile with choke cavity are fastened, for example by screwing, in the outer frame so that the transparent disks and the sheet are simultaneously locked in their positions.

The invention is illustrated in the accompanying drawings in which

Figure 2:
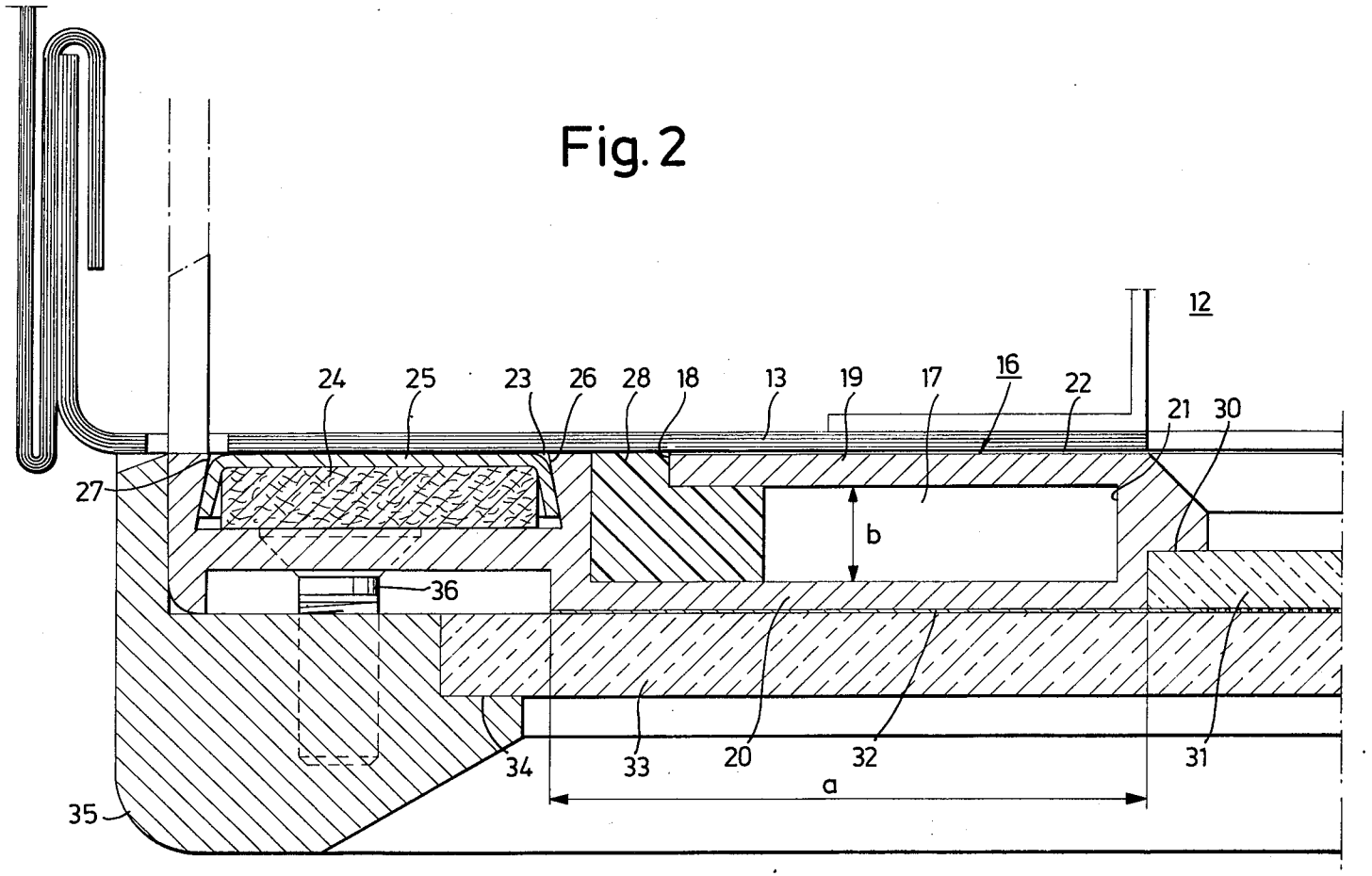
Figure 3:
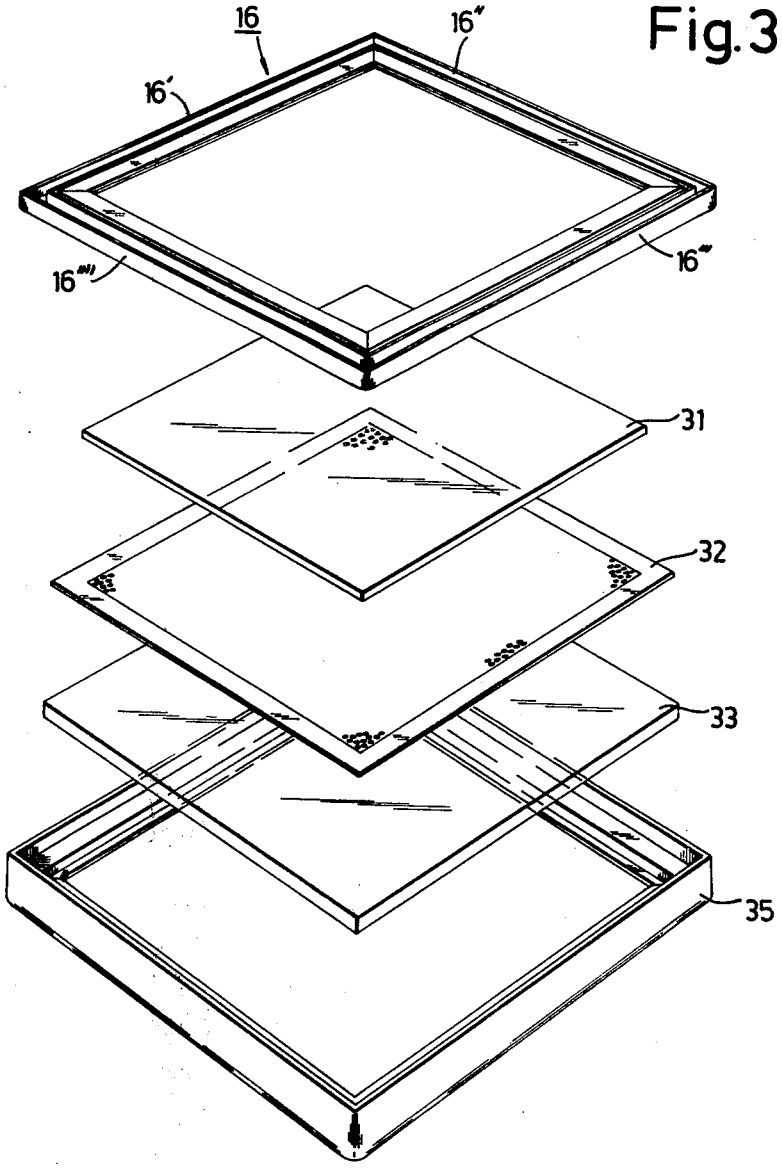

FIG. 1. shows a perspective view of a microwave oven with a door which can be constructed in accordance with the invention, FIG. 2 shows a sectional view through an outer portion of the door according to the invention and the front part of a cavity wall in the closed position of the door and FIG. 3 shows a perspective exploded view of the door in order to illustrate its construction and assembly.

In FIG. 1 reference numeral 10 designates an outer envelope of a microwave oven, which envelope has an actuation panel 11. Reference numeral 12 designates an oven cavity limited by conductive walls. A front surface 13 of the oven surrounds an entrance opening 14 which accomodates a door 15 by means of which the opening can be closed.

According to FIG. 2, which shows a sectional view through an edge portion of the door and the front part of a cavity wall in the closed position of the door, the said door consists, according to the invention, of an inner door frame which is shaped as a metal profile 16 having a choke cavity space 17 with entrance opening 18. The choke cavity space 17 is generally U-shaped with two legs 19, 20 oriented in the plane of the door and parallel with the front surface 13 in the closed position of the door and bottom 21 forming inner edge of the door frame and lying adjacent to the oven cavity space. In the closed position of the door the inner leg 19 of the U-shaped profile is situated at a small distance from the front surface 13 so that therebetween is a small gap 22 leading from the inside of the oven cavity to the entrance opening 18 of the choke. The distance between the entrance opening 18 of the choke and the bottom 21 of the choke is of the magnitude ¼ wave lengths of the operation frequency, whereby the choke in a known manner prevents or attenuates microwave leakage from the inside of the cavity. Beyond the choke space 17, as seen in the propagation direction for the leaking energy, the metal profile has an outer compartment 23 containing a body 24 of absorption material. The absorption body 24 is maintained in its position in the compartment 23 by a covering strip 25 having a groove shaped sectional area and manufactured of a resilient flexible low loss material. The strip 25 is kept in position in the outer compartment 23 by a snapping effect in combination with oblique walls 26, 27 in the compartment 23. The upper part of the choke cavity space 17, including the entrance opening 18, is, in the example shown, filled with a body 28 of dielectric material.

In its inner edge portion simultaneously forming bottom in the choke cavity the metal profile 16 has a shoulder 30 against which an inner glass disk 31 bears. Against the outside of the glass disk 31 bears a perforated metal sheet 32, the edge portion of which in turn bears against the leg 20 of the U-shaped choke section around the whole circumference. The overlapping distance a in FIG. 2 corresponds to the depth of the choke and is thus of the magnitude $\frac{1}{4}$ wavelengths of the operation frequency (generally 20–35 mm). Against the outside of the perforated sheet 32 lies an outer glass disk 33 which is pressed against the sheet by a shoulder 34 on an outer door frame 35. The outer and inner door frames 35 and 16, respectively, are kept together by a number of screws which, via apertures in the inner door frame 16, are screwed into the outer door frame 35. The outer door frame 35 is a mechanically rigid unit and can for example be moulded in one piece of aluminium or zinc. The inner door frame is, on the contrary, composed of a number of sections of the shown metal profile 16.

The width b of the choke 17 can be made small, for example about 5 mm (generally 2–20 mm) whereby the whole door will be very thin.

For illustrating the construction of the door FIG. 3 shows an exploded view of the door. At the upper part in FIG. 3 one can recognize the inner door frame 16 composed of four identically equal sections 16', 16'', 16''', 16'''' of the metal profile. Below this is the inner glass disk 31, the metal sheet 32, the outer glass disk 33 and outer door frame 35.

Assembly of the door can be effected in the following manner.

The outer door frame 35 is put on a support with the outside facing downward.

The outer glass disk 33 is put into the outer door frame.

The perforated sheet 32 is put upon the outer glass disk 33.

The inner glass disk 31 is put upon the sheet 32.

Then the metal profile sections 16', 16'''' are fastened by screwing in the outer frame 35 and will thereby lock both glass disks 31 and 33 and the sheet 32. Beforehand plastic strips 28 have been introduced into the profiles.

Damping material (24, see FIG. 2) is put into the metal profiles and covering strips 25 of low loss material are fastened by a snapping action outside the damping material.

As a result of the described construction the door will be rigid, thin and substantially planar and the assembly is very simple as it only requires that the parts be placed into each other, for example with aid of a jig, whereafter a number of screws are fastened. In spite of the simplicity of the construction and assembly the sealing of the microwave leakage through the door will be effective as a result of the large overlapping surface (the distance a in FIG. 2) between the metal profile and the metal sheet. Galvanic contact between the metal sheet and the metal profile is not necessary as the sealing will be fully effective in a capacitive manner provided that the distance between the sheet and the profile does not exceed $0.004\lambda$(0.5 mm) which can easily be reached with the described construction.

The perforated sheet may, if desired, be glued against the outer glass disk 33 or possibly, if two glass disks are used, glued between the glass disks.

It is not necessary to have a mechanically rigid outer frame 35 but this can be replaced by an, as seen in a sectional view, right angle bent extension of the profile gripping about the edge portion of the outer glass disk 33 in the same manner as the edge 34 on the frame 35 in the example shown. This extension of the metal profile can suitably be somewhat flexible and pressed against the glass disk in the same manner as the outer frame 35, i.e. by means of screws. The mechanical rigidity of the door will in this case be produced by the glass disks, which can suitably be laminated together. As in this case there is nothing that keeps the sections of the metal profile together at the corners of the door except from the pressing against the outer glass disk it can then be suitable to arrange a corner piece at each corner of the door. If the perforated sheet is made thicker and more rigid possibly both glass disks can be omitted.

What is claimed is:

1. A microwave oven comprising conductive walls defining an oven heating cavity with an entrance opening in one wall, and a door mounted on said one wall so as to open and close the entrance opening to the oven cavity, said door comprising an inner door frame formed as a U-shaped metal profile extending around the circumference of the door and forming a U-shaped choke cavity as seen in a sectional view, a perforated metal sheet overlapping the metal profile and covering the area inside the door frame, the metal sheet bearing against the outside of a portion of the metal profile forming a leg of the U-shaped choke cavity, the depth of the choke cavity being determined by the length of said leg and being a quarter of a wavelength of the oven operation frequency, the said portion of the metal profile overlapped by the metal sheet being substantially plane, and mechanical compression means arranged to keep the metal sheet pressed against the metal profile by acting between a part bearing against the outside of the metal sheet and the metal profile.

2. An oven as claimed in claim 1 wherein the door further comprises a transparent disk arranged outside the metal sheet and said mechanical compression means act against the edge portion of the transparent disk.

3. An oven as claimed in claim 2, characterized in that said compression means further comprises a shoulder on an outer frame bearing against the outside of the transparent disk, which outer frame is pressed against the metal profile by the compression means so that said shoulder presses the disk against the outside of the metal profile with intermediate perforated metal sheet.

4. An oven as claimed in claim 3, characterized in that the outer door frame comprises a mechanically rigid frame construction moulded in one piece and the inner door frame is composed of a number of sections of the metal profile.

5. An oven as claimed in claim 3 wherein the door further comprises an inner transparent disk, characterized in that the metal profile as seen in a sectional view has a shoulder for the inner transparent disk so that said disk will be kept in position between the said shoulder on the metal profile and the perforated sheet due to the pressing together of the outer frame and the metal profile.

6. A method of manufacturing a door for a microwave oven including a door frame in the shape of a metal profile extending around the circumference of the door and having a choke cavity, a perforated metal sheet overlapping the metal profile and covering the area inside the door frame, at least one transparent disk covering the metal sheet, and an outer door frame in the shape of a mechanically rigid unit, the method comprising placing the outer door frame on a support with its outside down, putting the transparent disk on the outer door frame, placing the perforated metal sheet upon the disk, and thereafter fastenaing sections of the metal profile to the outer frame so that the transparent disk and the metal sheet are locked in position.

7. The method of claim 6 comprising the further step of placing an inner transparent disk on the metal sheet after the metal sheet is placed on the disk and before the metal profile is fastened to the outer frame.

* * * * *

UNITED STATES PATENT AND TRADEMARK OFFICE

CERTIFICATE OF CORRECTION

PATENT NO. : 4,146,768

DATED : March 27, 1979

INVENTOR(S) : GUSTAV G. ORKE ET AL

It is certified that error appears in the above-identified patent and that said Letters Patent is hereby corrected as shown below:

Claim 5, line 7, after "outer" insert --door--

Signed and Sealed this

*Ninth* Day of *July 1985*

[SEAL]

*Attest:*

DONALD J. QUIGG

*Attesting Officer* *Acting Commissioner of Patents and Trademarks*